US009796945B2

(12) United States Patent
Behan et al.

(10) Patent No.: US 9,796,945 B2
(45) Date of Patent: Oct. 24, 2017

(54) PERFUME COMPOSITIONS

(71) Applicant: Johnson & Johnson Consumer Inc., Skillman, NJ (US)

(72) Inventors: John Martin Behan, Ashford (GB); John Paul Behan, Ashford (GB); Leslie Edward Fermor Small, Ashford (GB)

(73) Assignee: Johnson & Johnson Consumer Inc., Skillman, NJ (US)

( * ) Notice: Subject to any disclaimer, the term of this patent is extended or adjusted under 35 U.S.C. 154(b) by 0 days.

(21) Appl. No.: 15/008,981

(22) Filed: Jan. 28, 2016

(65) Prior Publication Data

US 2016/0222316 A1 Aug. 4, 2016

Related U.S. Application Data

(60) Provisional application No. 62/110,747, filed on Feb. 2, 2015.

(51) Int. Cl.
*C11B 9/00* (2006.01)

(52) U.S. Cl.
CPC ..... *C11B 9/0061* (2013.01); *C11B 9/00* (2013.01); *C11B 9/003* (2013.01); *C11B 9/0015* (2013.01); *C11B 9/0019* (2013.01); *C11B 9/0034* (2013.01); *C11B 9/0042* (2013.01); *C11B 9/0046* (2013.01); *C11B 9/0076* (2013.01); *C11B 9/0084* (2013.01)

(58) Field of Classification Search
CPC ..... C11B 9/00
See application file for complete search history.

(56) References Cited

U.S. PATENT DOCUMENTS

| | | | | |
|---|---|---|---|---|
| 4,281,204 | A | 7/1981 | Willis et al. | |
| 5,162,588 | A | 11/1992 | Fehr et al. | |
| 5,482,635 | A * | 1/1996 | Behan | A61K 8/33 510/102 |
| 5,990,076 | A | 11/1999 | Gaudin et al. | |
| 6,475,473 | B1 | 11/2002 | Perring et al. | |
| 2009/0081755 | A1 | 3/2009 | Schmiedel et al. | |
| 2012/0039753 | A1* | 2/2012 | Diersing | A61L 9/01 422/123 |
| 2013/0065807 | A1 | 3/2013 | Eh et al. | |

FOREIGN PATENT DOCUMENTS

| | | | |
|---|---|---|---|
| DE | 102005054565 | A | 5/2007 |
| EP | 1291409 | A | 3/2003 |
| EP | 1820842 | A | 8/2007 |
| EP | 2568035 | A | 3/2013 |
| EP | 2594626 | A | 5/2013 |
| EP | 2594626 | B | 5/2013 |

(Continued)

OTHER PUBLICATIONS

International search report dated May 24, 2016, for corresponding international application PCT/US2016/015286.

(Continued)

*Primary Examiner* — Lanee Reuther

(57) ABSTRACT

A perfume composition includes groups of perfume components that produce enhanced sensory performance. The composition includes components that have synergistic odor properties.

5 Claims, 4 Drawing Sheets

(56) References Cited

FOREIGN PATENT DOCUMENTS

| | | |
|---|---|---|
| WO | WO 1983/003095 A | 9/1983 |
| WO | WO 2002/049600 A | 6/2002 |

OTHER PUBLICATIONS

International search report and written opinion dated Oct. 5, 2016, for international application PCT/US2016/044199.
Lawless, "The Art of Blending & Training our Sense of Smell", Aqua Oleum (Oct. 12, 2015), pp. 1-2 (XP002762187), retrieved from the internet URL:http://www.aqua-oleum.co.uk/blog/the_art_of_blending_and_training_our_sense_of_smell/.
Cain, W. S. and Drexler, M., "Scope and evaluation of odor conteraction and masking", *Annals of the New York Academy of Sciences*, 1974, 237(1):427-439.
Cain, W. S., "Odor Intensity: Mixtures and Masking", *Chemical Senses*, 1975, 1(3):339-352.
Cain, W. S., "Bilateral interaction in olfaction", *Nature*, 1977, 268:50-52.
Duchamp-Viret et al., "Single olfactory sensory reurons simultaneously integrate the components of an odour mixture", *European Journal of Neuroscience*, 2003, 18:2690-2696.
Ferreira, V., "Resvisitng psychophysical work on the quantitative and qualitative odour properties of simple odour mixtures: a flavour chemistry view. Park 1: intensity and detectability. A review.", *Flavour and Fragrance Journal*, 2012, 27(2):124-140.
Ishii et al., "Synergy and masking in Odor Mixtures: An Electrophysiological Study of Orthonasal vs. Retronasal Perception", *Chemical Senses*, 2008, 33:553-561.
Kim, Ki-Hyuan, "The averaging effect of odorant mixing as determined by air dilution sensory tests: a case study on reduced sulfur compounds", *Sensors*, 2011, 11(2):1404-1417.
Manual on Sensory Testing Methods, STP 434 (1968), pp. 19-22 and 29-30, Sponsored by ASTM Committee E-18, American Society for Testing Materials, Philadelphia, PA 19103, USA.
Miyazawa et al., "Synergistic Mixture Interactions in Detection of Perithreshold Odors by Humans", *Chemical Senses*, 2008, 33:363-369.
Miyazawa et al., "Psychometric Functions for Ternary Odor Mixtures and Their Unmixed Components", *Chemical Senses*, 2009, 34(9):753-761.
Riffell et al., "Characterization and Coding of Behaviorally Significant Odor Mixtures", *Current Biology*, 2009, 19:335-340.
Schutze et al., "Perceptual and Processing Differences Between Physical and Dichorhinic Ordor Mixtures", *Neuroscience*, 2014, 258:84-89.
Schutze, M., "Perceptual Integration of Odor Mixtures", from the Department of Clinical Neuroscience, Karolinska Instituute, Stockholm, Sweden, 2014.
Wilson, R. L. and Mainen, Z. F., "Early Events in Olfactory Processing", *Annual Review of Neuroscience*, 2006, 29:163-201.
Zou, Zhihua and Buck, L. B., "Combinatorial Effects of Odorant Mixes in Olfactory Cortex", *Science*, Mar. 2006, 311:1477-1481.

* cited by examiner

PERFUME COMPOSITIONS

This application claims the benefit of U.S. provisional application 62/110,747 filed on Feb. 2, 2015, the complete disclosure of which is hereby incorporated herein by reference for all purposes.

FIELD

This invention relates to perfume compositions with enhanced sensory performance, compositions including such perfume compositions, and methods of making and using such compositions. The invention includes perfumes created using materials capable of synergistic blending.

BACKGROUND

Odor detection is effected through olfactory receptors which are located in neurons in the olfactory epithelium in the nasal cavity. The signals from these neurons pass on to the glomeruli in the olfactory bulb and onto the higher center of the brain for further interpretation. Each receptor neuron expresses a single class of olfactory receptor, and olfactory receptor neurons of such a single type are distributed across the olfactory epithelium. The output fibers from these scattered neurons converge together on a single glomerulus in the olfactory bulb. Thus the signals from olfactory neurons coding for similar molecular properties/moieties carrying the same odor informational content will tend to converge on the same glomeruli in the olfactory bulb. A single odorant molecule will generally excite more than one class of olfactory neuron, and the pattern of excitation will be reproducible and characteristic of that molecule.

In this process the features of the odorant molecule are first fragmented and detected by the odor receptors. Then similar features of different odor molecules reinforce each other at the different odor receptors, and at the olfactory bulb level. The whole is then re-integrated to provide the odor perception, which can be as simple as a single percept. In this way the many odorous molecules emanating from a single flower can excite multiple neurons, whose signals recombine to produce a single olfactory experience which the observer can recognise as typical of the particular flower. A different flower may emit many of the same materials but the differences in levels and composition will be re-integrated to yield a different sensory percept that can be recognised as coming from the different flower.

This combinatorial approach has been proposed previously, but the detailed processes involved are yet far from understood. The complexity of the combinatorial mechanisms has been a recurring feature of olfactory research. Early studies of odor mixtures sought to chart and classify the sensory phenomena when odors were mixed, and developed terms to describe the observed changes in total intensity that were observed. These studies were limited to binary mixes due to the complexity of the phenomena involved.

Progress has proved equally tricky at a biological level. It has been observed that single olfactory neurons simultaneously integrated several chemical signals. However researchers stress that complex interactions occur between components, and that the responses of olfactory neurons are not simply predictable from the responses of their components. They found that the events that occurred at the receptor neurons themselves, without the contribution of later events at the olfactory bulb, could be linked to changes in perceived odor, e.g. due to one odorant dominating or even masking the effect of another. A natural odor would induce a multi-chemical integration at the olfactory receptor neuron which might be equivalent to a shift in their odor coding properties, such that they may play a major part in perception process as a whole.

Thus the issues underlying the challenge for researchers trying to understand odors are becoming clearer while the complexity and non-linearity of the observed phenomena is making even reliable classification difficult.

In nature it is common for the odor experience to arise from a complex mixture of odor molecules and for this mixture to be perceived as a single percept. This circumstance can be observed in animals and insects where olfactory signals can drive critical behaviours. For example, a moth can identify a flower which emits more than 60 materials of which 9 are detected by the olfactory system. These have been shown to behave as a single percept capable of driving flower-foraging behaviour. The encoding is organised through a population of glomerular coding units which are thought to combine the different features of the molecular stimulants into the singular percept (via a mechanism as yet unknown).

In human studies the detailed outcome of such odor mixing has been variable and unpredictable though some broad categories of response are regularly observed.

The convergent nature of processes occurring at the higher centres of olfactory processing necessarily means that odor mixtures are not always simple combinations of their components. This being said it is often possible for humans to perceive a complex odor mixture as a single whole, while also being able to decompose the experience into sensory sub-units. For example, when a malodor and perfume are mixed it is often possible to compartmentalise the experience such that the relative contributions of each odor type to the overall odor can be judged. So there exists a paradox: that the mix may be perceived as a single perceptual experience, while that experience may be subdivided on introspection.

The outcome of introspection may not reflect the relative intensities of the component stimuli, or even their odor character. Nevertheless the process can be sufficiently reproducible that it can be used to design new products which deliver useful benefits, e.g. deodorant perfumes.

In such masking scenarios it is usual for one odor to be employed to reduce the perception of a second, less-desirable odor. This is a common practice and routes to optimise the process have been developed. Examples of synergistic interactions between odors are extremely rare by comparison.

In a compilation study based on the results from 520 binary mixtures, the most likely outcome of odor mixing at levels above threshold was that the total intensity of the mix was below the sum of the component intensities, and below that which would be expected from auto-addition following Stevens' Law. Intensity of a single material tends to increase as a logarithmic function of its concentration (Stevens' Law), so the first of these findings is not unexpected, however the second finding is more surprising. It was also found that one of the two components reduced the intensity of the other, more than occurred the other way round. They also found that adding a third, fourth, or fifth iso-intense component did not lead to any increase in overall intensity. This indicated strong compression mechanisms in play.

As noted above, synergistic effects were found to be infrequent. When found, they were thought to be associated with 'synthetic phenomena', where a new different odor quality is created when mixing the two components. Some odor was perceived when mixing sub-threshold levels of odorants but it was not possible to rationalise the observations. It was concluded that any study of these effects would require both intensity and odor character to be measured simultaneously.

Synergy has been described as a higher level of sensory impact than one would expect based on the impacts of the unmixed components. One example is adding a sub-threshold amount of one odorant causing a small but measurable increase in the perceived intensity of another (beverage) odor or in the perceived sweetness of supra-threshold sucrose. It has been thought that the addition of small amounts of one material can occasionally lead to significant increases in the intensity of an aroma or flavour. However, these examples may not be considered definitive examples of synergy unless the sub-threshold stimuli had no odor themselves. Given the statistical nature of a threshold measure (e.g. the level at which 50% of subjects can detect its presence, and therefore 50% of subjects cannot) the added materials will have been supra-threshold for many of the subjects.

With such issues in mind, the first clear, unambiguous demonstration of synergy in odor detection in humans was shown. The materials were maple lactone mixed with the volatile carboxylic acids, acetic acid and butyric acid. Generally at detection threshold for binary mixtures, the threshold concentration of an individual component tended to be lower than the threshold of the component smelled alone, a phenomenon referred to as Agonism.

Researchers extended their studies to 3-component mixtures, but no universal theme emerged. They concluded that the rules for mixture interactions were such that each mixture must be treated separately and empirically.

In another supra-threshold study, binary mixes of a fruity and a woody odor, using ortho-nasal and retro-nasal stimulation were examined. The fruity intensity could be increased or decreased in mixtures depending on the level of the woody component. Synergy was reported based on eeg measures, where an enlarged N1 peak amplitude was found in some mixes. Other mixes, smelled retro-nasally, showed increased P2 amplitudes during eeg scans. These results may be evidence of both sensory and cognitive processes in play simultaneously during odor perception.

A study of alkyl sulphides and thiols led to the conclusion that the mixing of such materials with similar chemical structure could be characterised by an averaging effect over all components.

Binary mixes of L-carvone (caraway odor) and eugenol (clove odor) were presented at one nostril as a physical mixture versus each odorant presented separately at separate nostrils (dichorhinic mixing). Psychophysical and eeg responses were recorded. The dichorhinic mixtures were perceived as stronger then the physical mixes. The perceived odor character also differed between the two assessment methods. The eeg responses for the dichorhinic mixes showed differences for the P1 & N1 (more sensory) peaks. Taken together all the results show that significant Left-Right hemispheric interactions take place at the higher centers of the brain (or at least, post-glomeruli), and that the peripheral level is a site of significant interaction too.

In a later publication, it was shown that mixture quality (character) is not tied to any particular single component, indicating that we perceive an odor mixture more or less synthetically as a single percept. In his study the odor and its pleasantness of a mixture was generally intermediate between that of each of the individual components.

WO2002049600, which is incorporated by reference herein in its entirety, discloses perfume compositions with specific components to promote relaxed mood states.

The present invention seeks to address at least some of the issues described above. Specifically to identify groups of odor ingredients that can be used to create synergistic odor or perfume compositions and the resulting perfume compositions therefrom.

SUMMARY

The present invention relates to perfumes created using materials capable of synergistic blending in odor or flavor mixtures. The invention further includes products formed by incorporating such perfumes.

In one aspect of the invention, there may be a method of preparing a perfume composition by including materials, which when replacing a component of similar odour character in any of the multi-component examples described herein, provide an intensity increase for these new mixtures versus the similar use of a disclosed non-resilient ingredient.

DETAILED DESCRIPTION

Figure 1:
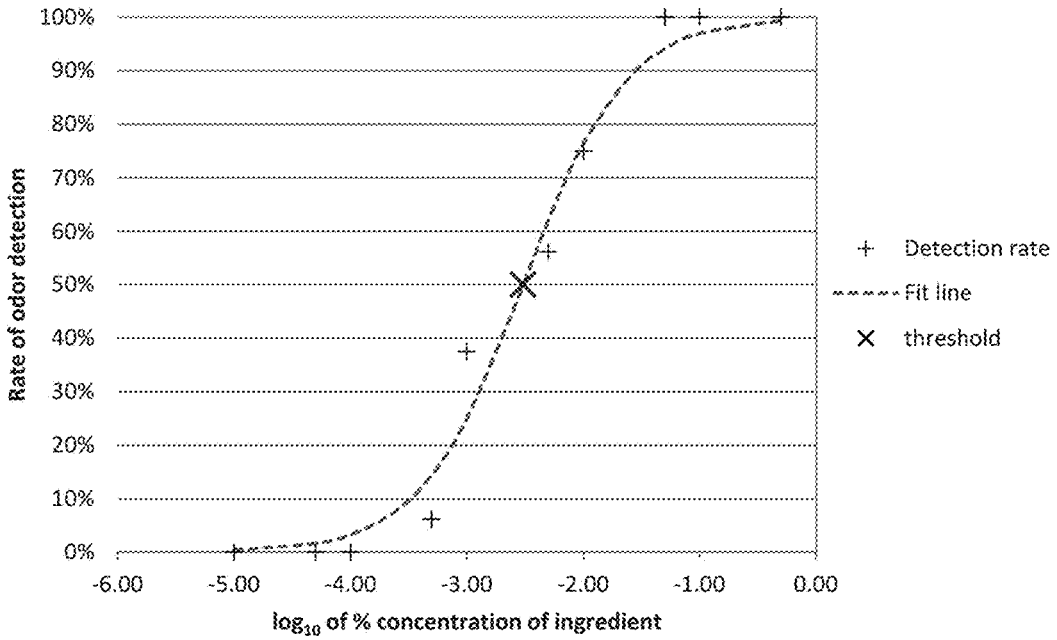
FIG. 1 is a graph showing a threshold value approximation.

The present invention has surprisingly found that specific combinations of ingredients can be used to create synergistic effects where the sensory impact of ingredients in the mix, or of the mix as a whole, is greater than one would expect based on the impacts of the unmixed components. Further, the present invention relates to compositions that include the synergistic effects, as well as methods of using such compositions to achieve desired responses in users, such as humans.

Those ingredients which are more prominent in the mix than expected are referred to herein as 'resilient' materials and, not to be limited by theory, certain components of perfume compositions have been found to be more resilient than others. The present invention identifies these resilient odor components, including how to identify such resilient odor components and determine threshold levels, and further outlines how they can be combined beneficially with other perfume components. Resilient materials may also combine their odor with other ingredients present to create a new and different odor character in the mixture.

In a first aspect of the invention the perfume composition comprises components from specific groups. The groups, described below, are referred to as Group 1A, Group 1B, and 1C. Perfume compositions of the present invention may include one or more components from one, two or all three of Groups 1A, 1B and 1C.

The first component (Group 1A) is selected from the group consisting of: acetyl cedrene, Camphor powder synthetic, Cedarwood oil, cineole, cinnamic aldehyde (10), cistus labdanum, citral dimethyl acetal, Cosmone, Cyclal C, beta damascone (10), delta damascone (10), Ebanol (10), ethyl vanillin (10), eugenol, Galbanone (10), gamma undecalactone, heliotropin, hexyl cinnamic aldehyde, iso E Super, alpha iso methyl ionone, Mayol, methyl chavicol, methyl cinnamate, methyl ethyl 2 butyrate, Silvanone, Silvial, alpha terpineol, allyl hexanoate, Labienoxime (10), anisic aldehyde(10), Black Pepper Oil, Polysantol(10), Habanolide, dihydroeugenol, Melonal, Violetyne(10), methyl benzoate, Raspberry ketone, and mixtures thereof. Group 1A includes components that are active or resilient components in the perfume compositions of the present invention.

Throughout this specification when an individual component includes "(10)" it signifies a 10% solution of the named material in a solvent, preferably an odourless solvent, including by way of example: dipropyleneglycol.

The second component (Group 1B) is selected from the group consisting of alkyl alcohols, phenyl alkylalcohols, terpene hydrocarbons or mixtures thereof. The components of Group 1B can be added as part of natural oils. Components of Group 1B are described herein as "promoters".

Specific examples of the Group 1B components include: linalol, orange terpenes, phenyl propyl alcohol, phenyl ethyl alcohol, alpha terpineol, Mayol, Mefrosol, citronellol, tetrahydrogeraniol, tetrahydrolinalol, geraniol; and mixtures thereof. The components of Group 1B have been found to further enhance the synergistic effect of the components of Group 1A.

The third component (Group 1C) may be selected from the group consisting of aldehyde C12 (10), anethole, Ambermax (10), isobornyl acetate, Calone 1951 (10), coumarin, cuminic aldehyde (10), Ginger oil, Oakmoss synthetic, Patchouli oil, undecavertol, Vetiver oil; and mixtures thereof. The materials from Group 1C can also be added as part of natural oils. Materials from Group 1C are optional in the composition.

As noted above, one or more components of one, two or three Groups may be used in the present invention. One or more components from Group 1A is present in the composition in amounts from about 20% to about 80% by weight of the composition, or from about 30% to about 80% by weight of the composition, or from about 40% to about 80% by weight of the composition, or from about 50% to about 80% by weight of the composition, or from about 30% to about 60% or from about 50% to about 60% by weight of the composition. The number of individual components from Group 1A can be one, two, three, four or more than four. When present, one or more components from Group 1B is present in the composition in amount from about 5% to about 50% by weight of the composition, or from about 15% to about 50% by weight of the composition, or from about 25% to about 50% of the composition or from about 15% to about 25%, or from about 10% to about 20% by weight of the composition. The number of individual components from Group 1B, when included in the composition, can be one, two, three, four or more than four. A component from Group 1C, when present, is present in the composition in amounts up to about 35% of the composition or from about 18% or less by weight of the composition. The number of individual components from Group 1C, when included in the composition, can be one, two, three, four or more than four.

Thus, one aspect of the present invention includes a combination of the aforementioned Groups 1A, 1B, and 1C.

A second aspect of the present invention includes materials that are limited in their use in the composition, or materials that are excluded. There are two groups of these materials in the present invention: Group 2A and Group 2B.

Group 2A includes allyl cyclohexyl propionate, Bangalol, Bourgeonal, Cassis bases, ethyl methyl phenyl glycidate, ethylene brassylate, Florosa, Herboxane, cis 3 hexenyl methyl carbonate, Jasmatone, Lemonile, Lilial, methyl anthranilate, Methyl Laitone, phenyl ethyl phenylacetate, Rose oxide, styrallyl acetate, Traseolide, Ultravanil, Ylang oil and mixtures thereof.

Group 2B includes isononyl acetate, linalyl acetate, and mixtures thereof.

When present, the materials in Group 2A or Group 2B are independently present in the composition at no more than about 1.0% by weight of the composition, and more preferably no more than about 0.6% by weight of the composition (other than as a component of a natural oil). Thus, the materials of Group 2A, when used independently from being present in a natural oil, may be present in an amount of from zero percent to about 1.0% or up to about 0.6% by weight of the perfume composition. Similarly, the materials of Group 2B, when used independently from being present in a natural oil, may be present in an amount of from zero percent to about 1.0% or up to about 0.6% by weight of the perfume composition.

The total concentration of non-essential oil additions of materials from Groups 2A and 2B comprises less than 2% by weight of the total perfume composition, and more desirably less than about 1% by weight of the total perfume composition. In some embodiments, the perfume compositions of the present invention are free of any materials from group 2A, and in some embodiments, the perfume compositions of the present invention are free of any materials from group 2B.

All percentages are based on total weight of materials in the perfume composition (other than that added as part of a natural essential oil), the total percentage of an essential oil or analogue (where it is a named ingredient), and 10 times the actual concentration of the pure material where it is noted as followed by (10), such as for aldehyde C12 (10). Where a material appears in two or more groups then its contribution should be considered as split between the groups (e.g. Mayol, alpha terpineol); e.g. 50:50 between two groups.

The present invention has surprisingly found that specific combinations of ingredients can be used to create synergistic odor or perfume compositions. Not to be limited by theory, certain components of the perfume composition have been found to be more resilient than others. A resilient odor component is one that provides a character to the entire composition greater than would be expected to otherwise provide based on the odor properties of the single material. The present invention identifies resilient odor components which are more easily identified in mixes and their odor character becomes a clear component of the odor character of the mixture as a whole. Another benefit of the present invention is that the presence of resilient materials leads can lead to a new and different odor character being created in the mixture. The present invention is quite useful in that it achieves providing a stronger, or more complex, or unique perfume while avoiding the need for adding more ingredients in the composition. For example, a resilient component may give a higher perceived intensity while using less of that resilient component in the perfume composition.

When odor mixtures are created from equal proportions of iso-intense ingredients, the mixtures containing significant proportions of 'resilient materials' are often associated with higher perceived intensity than mixtures where they are absent.

The odor character contribution of a second group of materials, 'non-resilient materials', is reduced on mixing with more resilient materials. In certain compositions, these non-resilient materials may be masked altogether. Therefore the amounts of the non-resilient materials, such as those listed in Groups 2A and 2B, in the compositions should be limited in the levels described above, if used at all. Resilient components, such as those in Group 1A, should be present in a significantly higher amount than components in Group 2A and/or in Group 2B.

Thus, the aforementioned aspect of the invention includes perfume compositions including one or more component selected from at least one of Groups 1A, 1B and 1C in combination with a component from one or more of Groups 2A and 2B.

A third group of materials tend to be present when resilient materials and/or mixes containing them are enhanced, but do not generally demonstrate such a prominent olfactory contribution themselves. These are the Group 1B promoters. Many of the Group 1B promoters are alcohols, which are general blending materials. This invention has surprisingly found that the Group 1B materials promote the contribution of the resilient material in the perfume composition. The Group 1B promoters increase the intensity of the resilient component(s). Group 1B promoters will increase the intensity of the Group 1A material(s) without the odor of the Group 1B promoter coming through prominently. The Group 1B promoters are optionally included in the perfumes of the present invention.

A threshold concentration of an odor component is the minimum concentration at which the odor is perceived. These behaviours can be demonstrated in mixes where all the components are present as iso-intense stimuli in equal parts at threshold concentrations. Threshold concentration can be considered as a standard level for creating iso-intense concentrations, which can be identified relatively unambiguously for all materials. If no interactions were to take place between the iso-intense components of a mixture, then each material would be perceived equally. If some materials became more olfactorily prominent, and/or intense, then it is judged that their odor has been enhanced by the presence of the other materials. Thus forming mixtures with iso-intense materials gives a useful approach to identify when and how enhancement may take place within a mixture or for the mixture as a whole. At threshold levels of perception of the odor component such enhancement is more easily identified.

A useful solvent for making liquid phase samples at threshold concentration is dipropylene glycol (dpg). The concentration of perfumery material is generally so small in such compositions that physical effects between materials at threshold will be very small, and the main effects will be sensory.

The present invention includes perfume compositions that include components that are consistently perceived at intensities above threshold in mixtures, while their concentration remains at threshold concentration level. Thus, the intensity of the odor of one or more components is increased through the present invention, even though the actual amount of the one or more components is at the threshold concentration level.

It is noted that it is possible to increase the intensity of a particular facet of odor character by using trivial additions, but the present invention goes beyond the mere use of trivial additions described herein. Trivial additions include adding materials of the same odor facet to achieve a greater odor. For example, it is possible to combine materials at or below threshold concentration such that in combination they produce an odor above threshold perception level. This can be achieved by combining only materials which each act partially or totally at the same receptor(s). Such groups of materials will usually be identifiable in that they have similar odors or shared odor facets. For example, combining sub-threshold amounts of different rose-smelling materials may produce a suprathreshold mixture with a rose odor. However, this alone is not the mechanism of the present invention. The resilient odor components in the compositions of the present invention produce enhanced effects and odor intensity benefits. This can be achieved without the simultaneous presence of other materials with shared odor characteristics. Of course, the present invention does not exclude their use with such materials. The approach of blending materials only having similar odor characteristics is described above by way of example to differentiate the alternative approach to 'apparent enhancement', which is based on trivial additive effects.

In addition to the resilient odor components used in the present invention, a second component may be added. Added second component materials may not play such a prominent olfactory role themselves in the overall odor profile of the mixture. They may not be perceived as among the most intense components, however neither do they strongly dilute or detract from the intensity performance of mixtures containing resilient materials. It has been surprisingly found that the combination of resilient odor components with a second component produces mixtures with useful, enhanced performance (e.g., higher perceived intensity of the mix with the resilient odor component).

The perfume or fragrance compositions according to the present invention can be used in a variety of products. As used herein, the term "product" shall refer to products including perfume compositions described above, and includes consumer products, medicinal products, and the like. Such products can take a variety of forms including powders, bars, sticks, tablets, creams, mousses, gels, lotions, liquids, sprays, and sheets. The amount of perfume composition in such products may lie in a range from 0.05% (as for example in low odor skin creams) to 30% (as for example in fine fragrances) by weight thereof. The incorporation of perfume composition into products of these types is known, and existing techniques may be used for incorporating perfumes for this invention. Among various methods to incorporate perfume compositions into a product include mixing the perfume composition directly into or onto a product, but another possibility is to absorb the perfume composition on a carrier material and then admix the perfume-plus-carrier mixture into the product.

To provide a more concise description, some of the quantitative expressions given herein are not qualified with the term "about". It is understood that whether the term "about" is used explicitly or not, every quantity given herein is meant to refer to the actual given value, and it is also meant to refer to the approximation to such given value that would reasonably be inferred based on the ordinary skill in the art, including approximations due to the experimental and/or measurement conditions for such given value.

The present invention includes perfume compositions and products including such perfume compositions, as well as methods of using such perfume compositions and products. The methods of use include providing a perfume composition or product as described herein to a human and allowing the human to smell the resulting odor to achieve a desired effect. The desired effect may include, for example, providing to a user (such as a human) emotional benefits, cognitive benefits, and/or improved interactions with perceptions in other modalities.

The present invention also includes a method to evaluate certain perfumes/odors and determining the threshold concentration for a perfume or flavour that can be used to identify the benefits of the invention. The evaluation may then be used to produce a perfume composition (or product including the perfume composition) with the desired threshold amount of the fragrance desired. Thus, there is provided a method of determining a threshold amount of a fragrance, and preparing a perfume composition using the results of the evaluation. The method may further include forming a product with the perfume composition.

In the examples and description below, the method includes use of a solvent. The solvent in the examples is dipropylene glycol, sometimes referred to here as dpg, though other low odor or odourless solvents may be used.

In these examples the threshold in dpg of each ingredient was first determined and then each ingredient was incorporated into the perfume at that level. Perfumes were also created with all the ingredients present at approximately 0.3 times threshold, and another set with all ingredients present at 0.1 times threshold concentration. For illustration the experiments below were carried out using a 10 ml aliquot of perfume in 125 ml brown glass jars.

Threshold Measurement

One suitable method for ascertaining the detection and/or recognition threshold of each odor ingredient from a liquid solution is derived from the Method of Limits (which is described in the ASTM 'Manual on Sensory Testing Methods', STP 434 (1968), American Soc for Testing Materials, Philadelphia, Pa. 19103, USA, the entire content of which is incorporated by reference herein). An initial experiment was conducted to determine the approximate threshold level. A concentration series of samples was made and diluted until no perfume odor was discernible. Then an ascending series of concentrations of a perfume ingredient in dipropylene glycol starting below threshold level, was presented to each assessor who then judged the presence or absence of the designated odor quality in each sample. The series continued until the judgement changed (from 'not present' to 'present'). Data from more than 15 assessments was pooled and analysed to interpolate the concentration in a series at which the target odor would have been detected (and/or recognised) in 50% of assessments.

The relationship between detection rates and $\log_{10}$ concentrations was hypothesised to be sigmoid; therefore to predict the 50% detection rate for each ingredient, a fit line was derived conforming to the function:

$$y = \frac{100\%}{1 + 10^{k(threshold - x)}}.$$

Where y is the percentage detection rate, x is the $\log_{10}$ of the percentage concentration of the ingredient in dipropylene glycol, k is the constant determining the gradient of the sigmoid function, and threshold is the concentration value at the inflection point of the sigmoid curve (and also therefore, the concentration at the 50% detection rate).

Values for k and threshold were approximated, then fitted using the solver add-in module of Microsoft XL 2007 such that root mean squared error (RMSE) between the observed and predicted points was minimised. The resultant RMSEs for all fit lines were below 10% and deemed acceptable. FIG. 1 shows a threshold value approximate for one sample perfume ingredient.

Assessment of Odor Intensity Measurement

A team of male and female assessors are used in the evaluation of sample intensity. In this work, the assessors were between the age of 25 and 65 years old. They were selected for evaluations on the basis of their ability to correctly rank the odour intensities of a series of dilutions (in dpg) of perfume ingredients. The standard perfume ingredient used in odour assessment sessions was benzyl acetate, prepared in a series of dilutions listed in the table below. Each dilution was associated with an odour intensity score. Other materials could be used in a similar fashion.

| Intensity Score | Benzyl Acetate in DPG | Odour description |
|---|---|---|
| 0 | 0% | No Odour |
| 1 | 0.005% | Slight |
| 2 | 0.016% | Weak |
| 3 | 0.05% | Definite |
| 4 | 0.10% | Moderate |
| 5 | 0.23% | Moderately Strong |
| 6 | 0.67% | Strong |
| 7 | 2.3% | Intense |
| 8 | 5.1% | Very intense |

Standard dilutions as above were present during evaluations and provided for reference to assist assessors in the evaluations.

The examples tested were prepared as described herein. The examples consisted of dilutions in dpg of mixtures of materials, at or above their individual threshold concentrations. In general approximately 10 g of each solution was placed in a capped 125 ml jar and allowed to equilibrate for a minimum of 2 hours at room temperature. Assessments were made by assessors removing the cap and smelling the contents. Jars were assessed in random order. Assessors assigned a score between 0 and 8 to each sample, with 0 corresponding to no odour and 8 representing very intense odour. After that, at least 15 assessments were obtained for each sample.

Where assessments for a sample are carried out over several sessions and/or with different subjects, it is possible to facilitate comparisons between samples by normalising the results for each sample across sessions and assessors. This may occur, for example, when too many samples are available for the assessor to be reliably assessed in one session. The data for Examples 1 to 12 was analysed in this fashion, as described below.

Assessors were presented with a segment of the samples in a series of sessions, in order to reduce the fatigue and inconsistency of assessment associated with a large number of samples. Each assessor's scores were standardised as follows: for each assessor, the mean of all the individual's scores within the session was calculated ($\overline{x}_{(assessor,\ session)}$), and the sample standard deviation of the same score set was calculated ($s_{(assessor,session)}$). Using these statistics, each of the assessor's data points was converted to a standardised score, that is, the $i^{th}$ score for each assessor ($x_i$) was recalculated into ($x_{std,i}$) as follows:

$$x_{std,i} = \frac{x_i - \overline{x}_{(assessor,session)}}{s_{(assessor,session)}}.$$

The data was further analysed using analysis of variance. The mean of all standardised scores, for all assessors ($\bar{x}_{std}$) was then calculated for each sample.

The Examples were made using a variety of fragrance ingredients listed in Table A. All example mixes were made volumetrically on the principle of adding a small known quantity of each stock solution (in dpg) to a vial and diluting to the required amount with additional clean dpg. Ideal stock solutions were such that 20 μL of each ingredient stock solution, when diluted further in a solution totaling 20 mL would deliver a solution of all ingredients at the estimated threshold concentration of each ingredient.

Stock solutions were prepared gravimetrically in serial dilution steps: e.g. to make a 0.0005% solution of an ingredient, 0.50 g were added to 9.50 g dpg resulting in a 5% solution totaling 10.00 g; 0.15 g of this solution would then be diluted in 14.85 g dpg, resulting in a 0.05% solution totaling 15 g; this second solution would then be diluted by the same dilution factor by adding 0.15 g of 0.05% solution to 14.85 g dpg, resulting in 15 g of 0.0005% solution.

Mixture stocks were stored in a refrigerator, in containers with very little residual headspace above the solution (minimising loss of volatiles).

Each Example was prepared by adding the target quantity of each stock solution to a vial and making up to a total of 20.0 g. Each mixture was then agitated and left to equilibrate. Each was used as-is, and was further diluted by a factor of 3/10 and 1/10, to produce the sub-threshold mixes. In this way, each mixture was prepared at 3 concentrations: (1) with each component at threshold concentration, (2) with each component at 0.3*threshold concentration and, (3) with each component at 0.1*threshold concentration.

TABLE A

| Perfumery Name | Chemical Name & other specialty names |
|---|---|
| 9 DECENOL-1-OL | 9-decen-1-ol |
| ACETYL CEDRENE | 1-[(3R,3aR,7R,8aS)-2,3,4,7,8,8a-hexahydro-3,6,8,8a-tetramethyl-1H-3a,7-methanoazulen-5-yl]-ethanone |
| ALDEHYDE C12 | dodecanal |
| ALLYL CYCLOHEXYL PROPIONATE | prop-2-enyl-3-cyclohexylpropanoate |
| ALLYL HEXANOATE | prop-2-en-1-yl hexanoate |
| AMBERMAX | 2H-2,44a-Methanonaphthalene-8-ethanol |
| AMBROX DL | dodecahydro-3a,6,6,9a-tetramethylnaptho-(2,1-b)-furan |
| ANETHOLE | (E)-4-methoxy-1-propenyl benzene |
| ANISIC ALDEHYDE | 4-methoxy benzaldehyde |
| AURANTION | methyl 2-[(7-hydroxy-3,7-dimethyloctylidene)amino]benzoate, = Aurantil Pure |
| BANGALOL | 2-ethyl-4-(2,2,3-trimethyl-1-cyclopent-3-enyl)but-2-en-1-ol, (Z)- & (E)-isomers |
| BENZALDEHYDE | benzaldehyde |
| BENZYL ACETATE | benzyl acetate |
| BOURGEONAL | p-tert-Butyldihydrocinnamaldahyde |
| CALONE 1951 | 3-(1,3-benzodioxol-5-yl)-2-methylpropanal |
| CAMPHOR POWDER SYNTHETIC | 1,7,7-trimethyl bicyclo(2.2.1)heptan-2-one |
| CASHMERAN | 1,1,2,3,3-pentamethyl-2,5,6,7-tetrahydroinden-4-one |
| CEDARWOOD OIL | |
| CINEOLE | 1,3,3-trimethyl-2-oxabicyclo(2.2.2)octane |
| CINNAMIC ALDEHYDE | 3-phenylprop-2-enal |
| CIS 3 HEXENOL | (Z)-hex-3-en-1-ol |

TABLE A-continued

| Perfumery Name | Chemical Name & other specialty names |
|---|---|
| CIS 3 HEXENYL METHYL CARBONATE | carbonic acid, 3-hexenyl methyl ester, (Z)- |
| *CISTUS* LABDANUM OIL | |
| CITRAL DIMETHYL ACETAL | 1,1-dimethoxy-3,7-dimethyl-2,6-octadiene |
| CITRONELLOL | 3,7-dimethyl-6-octen-1-ol |
| CITRONELLYL ACETATE | 3,7-dimethyl-6-octen-1-yl acetate |
| COSMONE | (5Z)-3-methylcyclotetradec-5-en-1-one |
| COUMARIN | 2H-1-benzopyran-2-one |
| CUMINIC ALDEHYDE | 4-propan-2-ylbenzaldehyde |
| CYCLAL C | 2,4-dimethyl-3-cyclohexene-1-carbaldehyde |
| CYCLAMEN ALDEHYDE | 2-methyl-3-isopropylphenyl-proprionaldehyde |
| DAMASCONE BETA | (E)-1-(2,6,6-trimethyl-1-cyclohexenyl)but-2-en-1-one |
| DAMASCONE DELTA | 1-(2,6,6-trimethyl-1-cyclohex-3-enyl)but-2-en-1-one |
| DECALACTONE GAMMA | 5-hexyl-furan-2(3H)-one |
| DIHYDRO EUGENOL | 2-methoxy-4-propyl-phenol |
| DIHYDROMYRCENOL | 2,6-dimethyl-7-octen-2-ol |
| DIMETHYL BENZYL CARBINYL ACETATE | (2-methyl-1-phenylpropan-2-yl) acetate, [or . . . benzeneethanol, a,a-dimethyl-, acetate] |
| EBANOL | (E)-3-methyl-5-(2,2,3-trimethyl-1-cyclopent-3-enyl)pent-4-en-2-ol |
| ETHYL 2 METHYL BUTYRATE | ethyl 2-methylbutanoate |
| ETHYL METHYL PHENYL GLYCIDATE | ethyl methyl phenyl glycidate, = EMPG |
| ETHYL SAFRANATE | ethyl 2,6,6-trimethylcyclohexa-1,3-diene-1-carboxylate |
| ETHYL VANILLIN | 2-ethoxy-4-formyl phenol |
| EUGENOL | 1-hydroxy-2-methoxy-4-(2-propyenyl)-benzene |
| FLOROSA | tetrahydro-4-methyl-2-(2-methylpropyl)-2H-pyran-4-ol |
| GALBANONE | 1-(5,5-dimethyl-1-cyclohexenyl)pent-4-en-1-one |
| GERANIOL | (2E)-3,7-dimethyl-2,6-octadien-1-ol |
| *GERANIUM* OIL | |
| GINGER OIL | |
| HABANOLIDE | (12E)-oxa cyclohexadec-12-en-2-one, |
| HELIOTROPIN | 1,3-benzodioxole-5-carbaldehyde |
| HERBOXANE | 2-butyl-4,4,6-trimethyl-1,3-dioxane |
| HEXYL CINNAMIC ALDEHYDE | 2-(phenyl methylene) octanal |
| INDOLE | 1H-indole, = Indole Pure |
| IONONE BETA | 4-(2,6,6-trimethyl-1-cyclohexen-1-yl)-3-buten-2-one |
| IRONE ALPHA | 4-(2,5,6,6-tetramethyl-2-cyclohexen-1-yl)-3-buten-2-one |
| ISO BORNYL ACETATE | (1,7,7-trimethyl-6-bicyclo[2.2.1]heptanyl) acetate |
| ISO BUTYL QUINOLINE | 2-(2-methylpropyl)quinoline |
| ISO E SUPER | 1-(2,3,8,8-tetramethyl-1,3,4,5,6,7-hexahydronaphthalen-2-yl)ethanone |
| ISO NONYL ACETATE | 3,5,5-trimethylhexyl acetate |
| JASMATONE | 2-hexylcycopentan-1-one |
| LABIENOXIME | 2,4,4,7-tetramethyl-6,8-nonadiene-3-one oxime |
| LEMONILE | 3,7-dimethyl-2,6-nonadienenitrile |
| LILIAL | 3-(4-tert-butylphenyl)butanal |
| LINALOL | 3,7-dimethyl octa-1,6-dien-3-ol |
| LINALYL ACETATE | 3,7-dimethyl-1,6-octadien-3-yl acetate |
| MANDARIN ALDEHYDE | (E)-dodec-2-enal |
| MANZANATE | ethyl 2-methylpentanoate |
| MAYOL | 4-(1-methylethyl)-cyclohexanemethanol |
| MEFROSOL | 3-methyl-5-phenylpentan-1-ol |
| MELONAL | 2,6-Dimethyl-5-heptenal |
| METHYL ANTHRANILATE | methyl 2-aminobenzoate |
| METHYL BENZOATE | methyl benzoate |
| METHYL CHAVICOL | p-allyl anisole |
| METHYL CINNAMATE | methyl 3-phenylprop-2-enoate |
| METHYL DIANTILIS | 2-ethoxy-4-(methoxymethyl)phenol |

TABLE A-continued

| Perfumery Name | Chemical Name & other specialty names |
|---|---|
| METHYL DIHYDRO-JASMONATE, = Hedione | cyclopentaneacetic acid, 3-oxo-2-pentyl-, methyl ester |
| METHYL IONONE ALPHA ISO | 3-buten-2-one, 3-methyl-4-(2,6,6-trimethyl-2-cyclohexen-1-yl) |
| METHYL LAITONE | 8-methyl-1-oxaspiro(4.5)decan-2-one |
| METHYL NAPHTHYL KETONE | 1-(2-naphthalenyl-ethanone |
| METHYL PAMPLEMOUSSE | 1,1-dimethox-2,2,5-trimethy-4-hexene |
| METHYL TUBERATE | 4-methyl-5-pentyloxolan-2-one |
| NONALACTONE GAMMA | dihydro-5-pentyl-2(3H)-furanone |
| NUTMEG OIL | |
| OAKMOSS SYNTHETIC | |
| ORANGE TERPENES (Orange Oil Terpenes) | |
| ORTHOLATE | 2-Tert-butylcyclohexyl acetate, = OTBCHA |
| PARA CRESYL METHYL ETHER | 1-methoxy-4-methyl benzene |
| PATCHOULI OIL | |
| PEPPER OIL BLACK | |
| PETITGRAIN PARAGUAY | |
| PHENYL ACETIC ACID | 2-phenyl acetic acid |
| PHENYL ETHYL ACETATE | 1-phenylethyl acetate, = styrallyl acetate |
| PHENYL ETHYL ALCOHOL | benzeneethanol |
| PHENYL ETHYL PHENYL ACETATE | 2-phenylethyl 2-phenylacetate |
| PHENYL PROPYL ALCOHOL | 3-phenylpropan-1-ol |

TABLE A-continued

| Perfumery Name | Chemical Name & other specialty names |
|---|---|
| POLYSANTOL | (E)-3,3-dimethyl-5-(2,2,3-trimethyl-3-cyclopenten-1-yl)-4-penten-2-ol |
| PTBCHA | p-tert-butyl cyclohexyl acetate |
| RASPBERRY KETONE | 4-(4-hydroxyphenyl)butan-2-one |
| ROSE OXIDE | 4-methyl-2-(2-methylprop-1-enyl)oxane |
| SAFRALEINE | 2,3,3-trimethyl-2H-inden-1-one |
| SILVANONE SUPRA | Cyclohexadecanolide + cyclopentadecanone |
| SILVIAL | 2-methyl-3-[4-(2-methylpropyl)phenyl]propanal |
| TERPINEOL ALPHA | alpha,alpha,4-trimethyl-3-cyclohexene-1-methanol |
| TETRAHYDRO GERANIOL | 3,7-dimethyl octan-1-ol |
| TETRAHYDRO LINALOL | 3,7-dimethyl-octan-3-ol |
| TRASEOLIDE | 1-(1,1,2,6-tetramethyl-3-propan-2-yl-2,3-dihydroinden-5-yl)ethanone |
| ULTRAVANIL | 2-ethoxy-4-methylphenol |
| UNDECALACTONE GAMMA | 5-heptyl-dihydro-2(3H)-furanone |
| UNDECAVERTOL | 4-methyl-3-decen-5-ol |
| VETYVER OIL | |
| VIOLETTYNE | 1,3-undecadien-5-yne |
| YLANG YLANG OIL | |

EXAMPLES 1-6

Fragrances Blended According to the Invention

TABLE 1

| Material | Group | Resilient/ Active | Estimated Threshold | Example 1 | Example 2 | Example 3 |
|---|---|---|---|---|---|---|
| Benzyl Acetate | | | 0.0066% | | 0.0066% | |
| Cashmeran | | | 0.0026% | | | |
| Cedarwood | 1a | ☐ | 0.0127% | 0.0127% | | |
| Cineole | 1a | ☐ | 0.00002% | | | |
| Cis 3 Hexenol | | | 0.0007% | 0.0007% | | |
| *Cistus* Labdnaum Oil | 1a | ☐ | 0.0038% | | | |
| Citral Dimethyl Acetal | 1a | ☐ | 0.0307% | | | 0.0307% |
| Citronellol | 1b | | 0.0031% | 0.0031% | 0.0031% | |
| Cyclal C | 1a | ☐ | 0.0003% | | | |
| Damascone Delta (10%) | 1a | ☐ | 0.0025% | | | |
| Dihydromyrcenol | | | 0.0010% | | | |
| Ebanol (10%) | 1a | ☐ | 0.0074% | | 0.0074% | |
| Ethyl 2 Methyl Butyrate | | | 0.00002% | | | |
| Ethyl Safranate | | | 0.0022% | 0.0022% | | |
| Eugenol | 1a | ☐ | 0.0010% | | | |
| *Geranium* oil | | | 0.0003% | | | |
| Linalol | 1b | | 0.0032% | | 0.0032% | |
| Manzanate | | | 0.000003% | | | 0.000003% |
| Methyl Chavicol | 1a | ☐ | 0.0022% | | | 0.0022% |
| Methyl Cinnamate | 1a | ☐ | 0.0069% | | 0.0069% | |
| Methyl Diantilis | | | 0.0030% | 0.0030% | | |
| Nutmeg Oil | | | 0.0016% | | | 0.0016% |
| Phenyl Ethyl Alcohol | 1b | | 0.0022% | | | |
| Terpineol Alpha | 1a | ☐ | 0.0205% | | | |
| total 1a: count (% in fragrance oil) | | | | 1 (58.32%) | 2 (52.64%) | 2 (95.41%) |
| total 1b: count (% in fragrance oil) | | | | 1 (14.14%) | 2 (23.08%) | 0 |
| total 1c: count (% in fragrance oil) | | | | | | |
| total 2a: count (% in fragrance oil) | | | | | | |
| total 2b: count (% in fragrance oil) | | | | | | |
| total others: count (% in fragrance oil) | | | | 3 (27.53%) | 1 (24.28%) | 2 (4.59%) |

TABLE 1-continued

| Material | Group | Resilient/ Active | Estimated Threshold | Example 4 | Example 5 | Example 6 |
|---|---|---|---|---|---|---|
| Benzyl Acetate | | | 0.0066% | | | |
| Cashmeran | | | 0.0026% | | 0.0026% | |
| Cedarwood | 1a | □ | 0.0127% | | | |
| Cineole | 1a | □ | 0.00002% | | 0.00002% | |
| Cis 3 Hexenol | | | 0.0007% | | | |
| *Cistus* Labdnaum Oil | 1a | □ | 0.0038% | | | 0.0038% |
| Citral Dimethyl Acetal | 1a | □ | 0.0307% | | | |
| Citronellol | 1b | | 0.0031% | | | |
| Cyclal C | 1a | □ | 0.0003% | | | 0.0003% |
| Damascone Delta (10%) | 1a | □ | 0.0025% | | 0.0025% | |
| Dihydromyrcenol | | | 0.0010% | 0.0010% | | |
| Ebanol (10%) | 1a | □ | 0.0074% | | | |
| Ethyl 2 Methyl Butyrate | | | 0.00002% | 0.00002% | | |
| Ethyl Safranate | | | 0.0022% | | | |
| Eugenol | 1a | □ | 0.0010% | 0.0010% | | |
| *Geranium* oil | | | 0.0003% | | | 0.0003% |
| Linalol | 1b | | 0.0032% | | 0.0032% | |
| Manzanate | | | 0.000003% | | | 0.000003% |
| Methyl Chavicol | 1a | □ | 0.0022% | | | |
| Methyl Cinnamate | 1a | □ | 0.0069% | | | 0.0069% |
| Methyl Diantilis | | | 0.0030% | | | |
| Nutmeg Oil | | | 0.0016% | | | |
| Phenyl Ethyl Alcohol | 1b | | 0.0022% | 0.0016% | | |
| Terpineol Alpha | 1a | □ | 0.0205% | 0.0205% | | |
| total 1a: count (% in fragrance oil) | | | | 2 (45.34%) | 2 (30.54%) | 3 (97.17%) |
| total 1b: count (% in fragrance oil) | | | | | 1 (38.63%) | |
| total 1c: count (% in fragrance oil) | | | | | | |
| total 2a: count (% in fragrance oil) | | | | | | |
| total 2b: count (% in fragrance oil) | | | | | | |
| total others: count (% in fragrance oil) | | | | 2 (4.29%) | 1 (30.83%) | 2 (2.83%) |

EXAMPLE 1

141.5 μL of a cis-3-hexenol solution at 0.10% in dpg, 50.7 μL of a cedarwood oil solution at 5.00% in dpg, 6.1 μL of a Methyl Diantilis solution at 9.93% in dpg, 44.6 μL of an Ethyl Safranate solution at 1.00% in dpg, and 18.4 μL of a citronellol solution at 3.34% in dpg, were added to 19.74 mL of dpg and mixed.

EXAMPLE 2

18.4 μL of a linalol solution at 3.50% in dpg, 15.1 μL of an Ebanol solution at 0.98% in dpg, 18.9 μL of a methyl cinnamate solution at 7.32% in dpg, 18.9 μL of a benzyl acetate solution at 7.01% in dpg, and 18.4 μL of a citronellol solution at 3.34% in dpg, were added to 19.91 mL of dpg and mixed.

EXAMPLE 3

189.3 μL of a citral dimethyl acetal solution at 3.25% in dpg, 8.9 μL of a methyl chavicol solution at 5.00% in dpg, 20 μL of a nutmeg oil solution at 1.50% in dpg, and 6.9 μL of a Manzanate solution at 0.01% in dpg, were added to 19.77 mL of dpg and mixed.

EXAMPLE 4

195.5 μL of a terpineol alpha solution at 2.10% in dpg, 18.2 μL of a dihydromyrcenol solution at 1.15% in dpg, 19.5 μL of a eugenol solution at 1.00% in dpg, 6.9 μL of a ethyl methyl-2-butyrate solution at 0.05% in dpg, and 88.7 μL of a phenyl ethyl alcohol solution at 0.50% in dpg, were added to 19.67 mL of dpg and mixed.

EXAMPLE 5

18.4 μL of a linalol solution at 3.50% in dpg, 8.9 μL of a cineole solution at 0.04% in dpg, 9.9 μL of a Cashmeran solution at 5.21% in dpg, and 9.2 μL of a damascone delta solution at 0.55% in dpg, were added to 19.95 mL of dpg and mixed.

EXAMPLE 6

5 μL of a Cyclal C solution at 1.01% in dpg, 15.1 μL of a cistus labdnaum oil solution at 4.99% in dpg, 13.8 μL of a methyl cinnamate solution at 10.00% in dpg, 6.9 μL of a Manzanate solution at 0.01% in dpg, and 126.2 μL of a geranium oil solution at 0.05% in dpg, were added to 19.83 mL of dpg and mixed.

EXAMPLES 7-12

Fragrances not Conforming to the Selection Rules for the Invention

TABLE 2

| Material | Group | Resilient/ Active | Estimated Threshold | Example 7 | Example 8 | Example 9 |
|---|---|---|---|---|---|---|
| Allyl Cyclohexyl Propionate | 2a | | 0.0087% | | 0.0087% | |
| Camphor | 1a | □ | 0.0016% | | | |
| Cis 3 Hexenyl Methyl Carbonate | 2a | | 0.00010% | | | 0.0001% |

TABLE 2-continued

| | | | | | | |
|---|---|---|---|---|---|---|
| Coumarin | 1c | | 0.00039% | | 0.00039% | |
| Cyclamen Aldehyde | | | 0.00010% | | 0.0001% | |
| Ethyl Methyl Phenyl Glycidate | 2a | | 0.0011% | 0.0011% | | |
| Ethyl Vanillin (10%) | 1a | □ | 0.0248% | | | |
| Florosa | 2a | | 0.00012% | | | 0.0001% |
| *Geranium* oil | | | 0.00032% | | | |
| Indole | | | 0.00017% | 0.0002% | | |
| Iso Bornyl Acetate | 1c | | 0.0055% | | | |
| Iso Nonyl Acetate | 2b | | 0.0126% | 0.0126% | 0.0126% | |
| Linalyl Acetate | 2b | | 0.0109% | | | |
| Mefrosol | 1b | | 0.0051% | | 0.0051% | |
| Methyl Dihydrojasmonate | | | 0.0020% | | | |
| Methyl Laitone | 2a | | 0.00003% | 0.00003% | | |
| ParaCresyl Methyl Ether | | | 0.00012% | 0.00012% | | |
| Patchouli | | | 0.00053% | | | 0.00053% |
| Phenyl Ethyl Phenyl Acetate | 2a | | 0.0075% | | | 0.0075% |
| total 1a: count (% in fragrance oil) | | | | | | |
| total 1b: count (% in fragrance oil) | | | | | 1 (19.08%) | |
| total 1c: count (% in fragrance oil) | | | | | 1 (1.44%) | |
| total 2a: count (% in fragrance oil) | | | | 2 (7.96%) | 1 (32.28%) | 3 (93.53%) |
| total 2b: count (% in fragrance oil) | | | | 1 (90.01%) | 1 (46.82%) | |
| total others: count (% in fragrance oil) | | | | 2 (2.03%) | 1 (0.38%) | 1 (6.47%) |

| Material | Group | Resilient/ Active | Estimated Threshold | Example 10 | Example 11 | Example 12 |
|---|---|---|---|---|---|---|
| Allyl Cyclohexyl Propionate | 2a | | 0.0087% | | 0.0087% | |
| Camphor | 1a | □ | 0.0016% | 0.0016% | | |
| Cis 3 Hexenyl Methyl Carbonate | 2a | | 0.00010% | | | |
| Coumarin | 1c | | 0.00039% | | | |
| Cyclamen Aldehyde | | | 0.00010% | | | |
| Ethyl Methyl Phenyl Glycidate | 2a | | 0.0011% | | | |
| Ethyl Vanillin (10%) | 1a | □ | 0.0248% | | 0.0248% | 0.0248% |
| Florosa | 2a | | 0.00012% | | | 0.0001% |
| *Geranium* oil | | | 0.00032% | | 0.00032% | |
| Indole | | | 0.00017% | | | |
| Iso Bornyl Acetate | 1c | | 0.0055% | | | 0.0055% |
| Iso Nonyl Acetate | 2b | | 0.0126% | | 0.0126% | |
| Linalyl Acetate | 2b | | 0.0109% | | 0.01085% | |
| Mefrosol | 1b | | 0.0051% | | | |
| Methyl Dihydrojasmonate | | | 0.0020% | 0.0020% | | |
| Methyl Laitone | 2a | | 0.00003% | 0.00003% | | |
| ParaCresyl Methyl Ether | | | 0.00012% | | | |
| Patchouli | | | 0.00053% | | | |
| Phenyl Ethyl Phenyl Acetate | 2a | | 0.0075% | 0.0075% | | 0.0075% |
| total 1a: count (% in fragrance oil) | | | | 1 (14.23%) | 1 (43.31%) | 1 (65.43%) |
| total 1b: count (% in fragrance oil) | | | | | | |
| total 1c: count (% in fragrance oil) | | | | | | 1 (14.52%) |
| total 2a: count (% in fragrance oil) | | | | 2 (67.51%) | 1 (15.17%) | 2 (20.05%) |
| total 2b: count (% in fragrance oil) | | | | | 2 (40.97%) | |
| total others: count (% in fragrance oil) | | | | 1 (18.26%) | 1 (0.55%) | |

EXAMPLE 7

10 μL of a para-cresyl methyl ether solution at 0.02% in dpg, 19.2 μL of an isononyl acetate solution at 13.11% in dpg, 20 μL of a Methyl Laitone solution at 0.0010% in dpg, 18.2 μL of an ethyl methyl phenyl glycidate solution at 1.20% in dpg, and 66.3 μL of an indole solution at 0.05% in dpg, were added to 19.87 mL of dpg and mixed.

EXAMPLE 8

17 μL of a Cyclamen Aldehyde solution at 0.12% in dpg, 19.2 μL of an isononyl acetate solution at 13.11% in dpg, 18.2 μL of a Coumarin solution at 0.42% in dpg, 18.3 μL of an allyl cyclohexyl propionate solution at 9.49% in dpg, and 103 μL of a Mefrosol solution at 1.00% in dpg, were added to 19.82 mL of dpg and mixed.

EXAMPLE 9

17.8 μL of a Florosa solution at 0.00012% in dpg, 141.5 μL of a cis-3-hexenyl methyl carbonate solution at 0.00071% in dpg, 19.4 μL of a patchouli oil solution at 0.00053% in dpg, and 186.9 μL of a phenyl ethyl phenyl acetate solution at 0.0075% in dpg, were added to 19.63 mL of dpg and mixed.

EXAMPLE 10

17.1 μL of a Galbanone solution at 1.02% in dpg, 17.1 μL of a vetyver oil solution at 2.48% in dpg, 19.5 μL of a eugenol solution at 1.00% in dpg, and 17.7 μL of a Methyl Anthranilate solution at 1.21% in dpg, were added to 19.93 mL of dpg and mixed.

EXAMPLE 11

183.3 μL of a linalyl acetate solution at 0.011% in dpg, 19.2 μL of an isononyl acetate solution at 0.013% in dpg, 18.5 μL of an ethyl vanillin solution at 0.0025% in dpg, 18.3 μL of an allyl cyclohexyl propionate solution at 0.0087% in dpg, and 126.2 μL of a geranium oil solution at 0.00032% in dpg, were added to 19.63 mL of dpg and mixed.

EXAMPLE 12

17.8 μL of a Florosa solution at 0.14% in dpg, 22 μL of an Isobornyl Acetate solution at 5.00% in dpg, 18.5 μL of an ethyl vanillin solution at 2.68% in dpg, 29.7 μL of a phenyl ethyl phenyl acetate solution at 5.04% in dpg, were added to 19.91 mL of dpg and mixed.

The range of odors available under the invention is extremely wide, and not limited to any particular segment. Odor descriptions of the perfume compositions in Table 3 below show non-limiting examples of the breadth of odor types available according to the invention. The intensity results are shown in Table 4,

TABLE 3

| Example | Odor Description |
|---|---|
| 1 | Citrus, spicy, green |
| 2 | Balsamic, floral |
| 3 | Spicy, sweet fruity |
| 4 | Fruity sweet |
| 5 | Thick, fruity |
| 6 | Fruity, green |
| 7 | Floral, fruity |
| 8 | Oriental, sweet |
| 9 | Floral, fatty |
| 10 | Spicy, fruity |
| 11 | Floral |
| 12 | Floral (lilac) |

TABLE 4

| Example | Concentration of ingredients | Mean of Standard Intensity | Std Dev of Standard Intensity |
|---|---|---|---|
| Ex 1 | Threshold | 2.20 | 0.31 |
| | Threshold 0.3 | 0.95 | 0.43 |
| | Threshold * .01 | −0.59 | 0.38 |
| Ex 2 | Threshold | 1.45 | 0.71 |
| | Threshold * 0.3 | 0.23 | 0.23 |
| | Threshold * 0.1 | −0.53 | 0.42 |
| Ex 3 | Threshold | 1.81 | 0.59 |
| | Threshold * 0.3 | 0.08 | 0.22 |
| | Threshold * 0.1 | −0.54 | 0.16 |
| Ex 4 | Threshold | 1.29 | 0.91 |
| | Threshold * 0.3 | 0.51 | 1.00 |
| | Threshold * 0.1 | −0.52 | 0.61 |
| Ex 5 | Threshold | 1.85 | 1.34 |
| | Threshold * 0.3 | 0.68 | 1.10 |
| | Threshold * 0.1 | −0.40 | 0.51 |
| Ex 6 | Threshold | 1.92 | 0.38 |
| | Threshold * 0.3 | 0.39 | 0.30 |
| | Threshold * 0.1 | −0.59 | 0.42 |
| Ex 7 | Threshold | 0.32 | 0.60 |
| | Threshold * 0.3 | −0.57 | 0.50 |
| | Threshold * 0.1 | −1.11 | 0.47 |
| Ex 8 | Threshold | 0.09 | 0.55 |
| | Threshold * 0.3 | −0.54 | 0.16 |
| | Threshold * 0.1 | −1.02 | 0.20 |
| Ex 9 | Threshold | 0.51 | 0.30 |
| | Threshold * 0.3 | −0.59 | 0.47 |
| | Threshold * 0.1 | −0.88 | 0.19 |
| Ex 10 | Threshold | 0.27 | 0.52 |
| | Threshold * 0.3 | −0.35 | 0.45 |
| | Threshold * 0.1 | −0.98 | 0.37 |
| Ex 11 | Threshold | 0.08 | 0.71 |
| | Threshold * 0.3 | −0.97 | 0.29 |
| | Threshold * 0.1 | −1.37 | 0.38 |
| Ex 12 | Threshold | 0.19 | 1.21 |
| | Threshold * 0.3 | −0.57 | 0.61 |
| | Threshold * 0.1 | −1.00 | 0.48 |

A two-way ANOVA was performed on the data set: the two qualitative predictive factors selected were named "Example", corresponding to the samples assessed, and "Concentration", corresponding to the three sample strengths; threshold, 0.3 ×threshold and 0.1 ×threshold.

The ANOVA determined that the two-factor model was a significant fit for the data ($F=23.440$, d.f.=13, $p<0.05$, $R^2=0.706$) at the 95% confidence level. Type 1 Sum of Squares analysis demonstrated significant contributions to the data variability by both Example ($F=9.703$, d.f.=11, $p<0.05$) and Concentration ($F=98.993$, d.f.=2, $p<0.05$) factors, as such significant differences were demonstrable between the samples at near-threshold concentrations. Model fit statistics are shown in Tables 5 and 6.

TABLE 5

Analysis of variance:

| Source | DF | Sum of squares | Mean squares | F | Pr > F |
|---|---|---|---|---|---|
| Model | 13 | 120.089 | 9.238 | 23.440 | <0.0001 |
| Error | 130 | 51.233 | 0.394 | | |
| Corrected Total | 143 | 171.321 | | | |

Computed against model Y = Mean(Y)

TABLE 6

Type I Sum of Squares analysis:

| Source | DF | Sum of squares | Mean squares | F | Pr > F |
|---|---|---|---|---|---|
| Example | 11 | 42.063 | 3.824 | 9.703 | <0.0001 |
| Concentration | 2 | 78.025 | 39.013 | 98.993 | <0.0001 |

Figure 2:
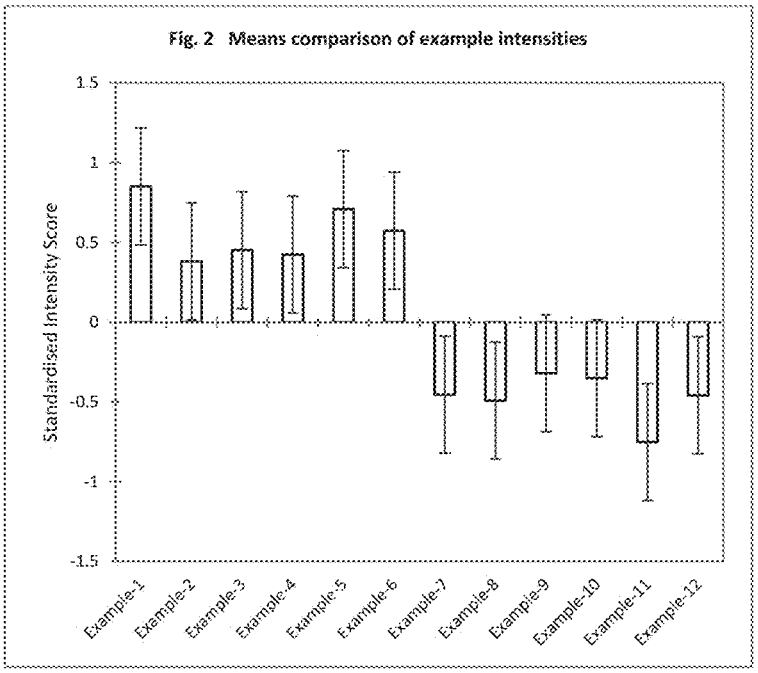
FIG. 2 is a bar graph showing the standardized intensity scores of Examples 1-12.

FIG. 2 shows the means and 95% confidence intervals for the standardised scores of the examples; note that examples 1-6 are shown to confidently score >0 whereas examples 7-12 have negative means.

Post-hoc Duncan analysis of the samples demonstrates significant differences between Examples according to the present invention (Examples 1-6) and comparative Examples 7-12. In Table 7, there is no mean difference between members of a group with the same letter, whereas significant differences exist between the means of samples in different groups (critical p=0.05). No sample was found to belong in both groups A and B. Therefore, Examples 1-6 can be said to significantly outperform Comparative Examples 7-12.

TABLE 7

| Example | LS means (Std Intensity) | Standard error | Groups | |
|---|---|---|---|---|
| 1 | 0.851 | 0.181 | A | |
| 2 | 0.381 | 0.181 | A | |
| 3 | 0.452 | 0.181 | A | |
| 4 | 0.424 | 0.181 | A | |
| 5 | 0.709 | 0.181 | A | |
| 6 | 0.573 | 0.181 | A | |
| 7 | −0.454 | 0.181 | | B |
| 8 | −0.492 | 0.181 | | B |
| 9 | −0.320 | 0.181 | | B |
| 10 | −0.351 | 0.181 | | B |
| 11 | −0.751 | 0.181 | | B |
| 12 | −0.458 | 0.181 | | B |

EXAMPLES A TO O

In a series of further examples, A to O, the intensity of each mixture was assessed by subjects in a separate experiment using a unipolar rating scale (a description of rating scales and their use may be found in the ASTM 'Manual on Sensory Testing Methods', STP 434 (1968), see in particular pp 19-22, American Soc for Testing Materials, Philadelphia, Pa. 19103, USA, which is incorporated by reference herein in its entirety).

In this scale 'no intensity' was rated 0 and other intensities were rated as described earlier. Perfume compositions were prepared following the general procedures described above for Examples 1 through 12. The weight percent of each ingredient in the compositions is shown in Tables 8-13. 10 ml of each perfume solution was placed in a 125 ml brown glass jar and allowed to equilibrate. Subjects assessed the jar contents and rated the perceived intensity of odour. The procedure was repeated over 3 sessions until 15 assessments were made.

Figure 3:
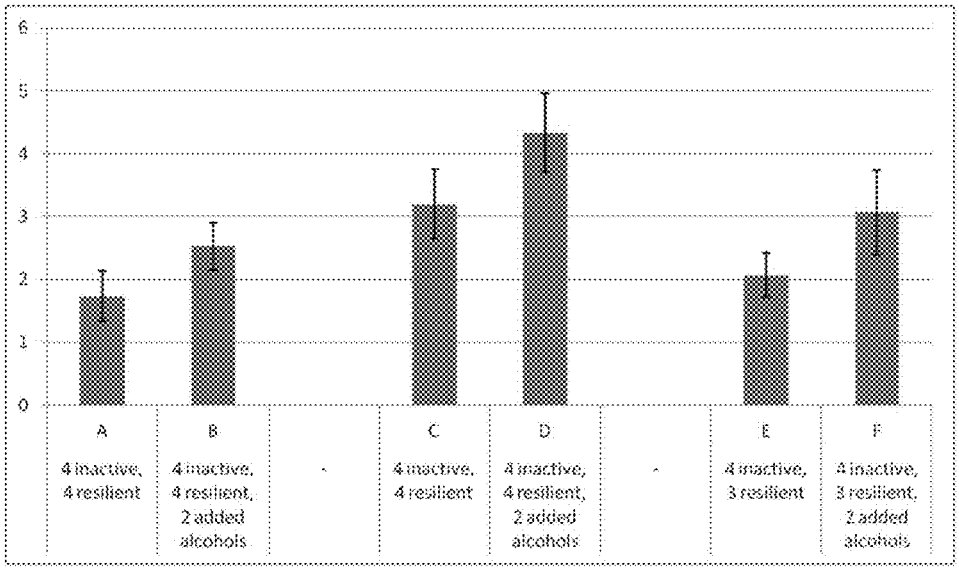
FIG. 3 is a bar graph showing the average intensity scores of Examples A-F.
Figure 4:
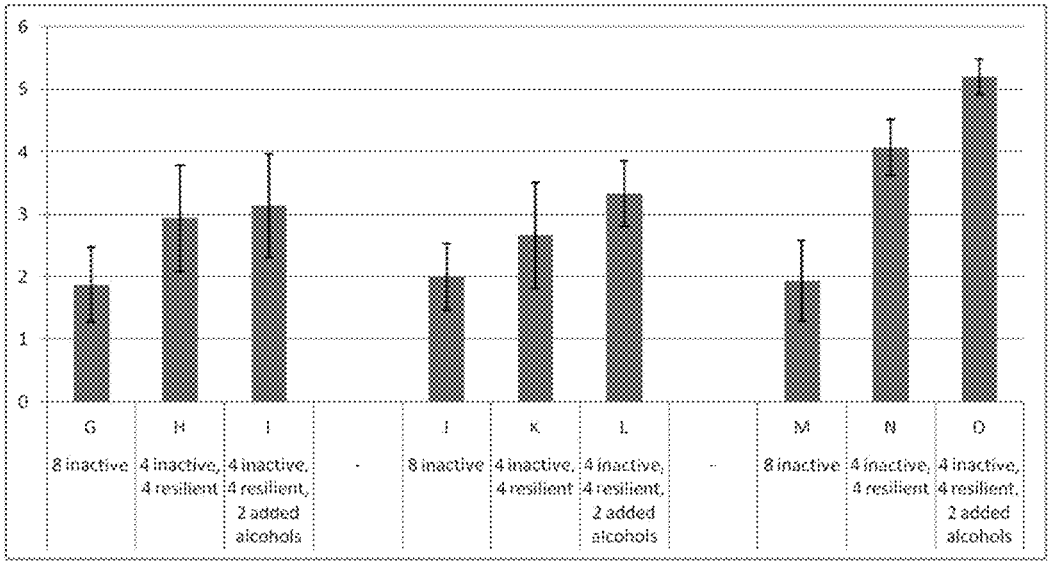
FIG. 4 is a bar graph showing the average intensity scores of Examples G-O.

The examples A to O, illustrate the benefits of the present invention: that a mixture according to the present invention will smell stronger when presented at threshold concentration than a similar mixture using materials that are with less-active or not active according to the present invention. In the examples the components that are less active or not active are labelled "Inactive". The components that are part of the present invention are labelled "Resilient or Active". Further, the combination of group 1a materials and group 1b materials (or similar alkyl alcohols), all present at threshold concentration, can deliver a sensory boost in its intensity. The average or mean scores of Examples A-O are shown in FIGS. 3 and 4. The black bars indicate a 95% confidence interval.

TABLE 8

| Material | Group | Resilient/ Active | Estimated Threshold | Mix A | Mix B |
|---|---|---|---|---|---|
| Methyl Benzoate | 1a | □ | 0.006 07% | 0.00597% | 0.00599% |
| Tetrahydro Linalol | 1b | | 0.000 20% | 0.00020% | 0.00020% |
| Violettyne | 1a | □ | 0.001 93% | 0.00192% | 0.00192% |
| Polysantol | 1a | □ | 0.000 92% | 0.00092% | 0.00091% |
| Ionone Beta | | | 0.000 90% | 0.00089% | 0.00089% |
| Dihydro Eugenol | 1a | □ | 0.000 96% | 0.00096% | 0.00097% |
| Decalactone Gamma | | | 0.000 36% | 0.00036% | 0.00036% |
| Allyl Hexanoate | 1a | □ | 0.002 35% | 0.00236% | 0.00234% |
| Tetrahydro Geraniol | 1b | | 0.010 87% | | 0.01075% |
| Phenyl Ethyl Alcohol | 1b | | 0.002 22% | | 0.00221% |
| total 1a: count (% in fragrance oil) | | | | 5 (89.33%) | 5 (45.72%) |

TABLE 8-continued

| Material | Group | Resilient/ Active | Estimated Threshold | Mix A | Mix B |
|---|---|---|---|---|---|
| total 1b: count (% in fragrance oil) | | | | 1 (1.47%) | 3 (49.59%) |
| total 1c: count (% in fragrance oil) | | | | | |
| total 2a: count (% in fragrance oil) | | | | | |
| total 2b: count (% in fragrance oil) | | | | | |
| total others: count (% in fragrance oil) | | | | 2 (9.19%) | 2 (4.69%) |

TABLE 9

| Material | Group | Resilient/ Active | Estimated Threshold | Mix C | Mix D |
|---|---|---|---|---|---|
| Methyl Benzoate | 1a | □ | 0.006 07% | 0.00605% | 0.00594% |
| Violettyne | 1a | □ | 0.001 93% | 0.00193% | 0.00189% |
| Iso Butyl Quinoline | | | 0.000 65% | 0.00065% | 0.00064% |
| Ambrox DL | | | 0.001 56% | 0.00156% | 0.00155% |
| Irone Alpha | | | 0.000 82% | 0.00082% | 0.00082% |
| Dihydro Eugenol | 1a | □ | 0.000 96% | 0.00096% | 0.00094% |
| Aurantiol | | | 0.000 09% | 0.00009% | 0.00009% |
| Labienoxime | 1a | □ | 0.000 25% | 0.00025% | 0.00025% |
| Tetrahydro Geraniol | 1b | | 0.010 87% | | 0.01064% |
| Linalol | 1b | | 0.003 22% | | 0.00321% |
| total 1a: count (% in fragrance oil) | | | | 4 (74.60%) | 4 (34.74%) |
| total 1b: count (% in fragrance oil) | | | | | 2 (53.32%) |
| total 1c: count (% in fragrance oil) | | | | | |
| total 2a: count (% in fragrance oil) | | | | | |
| total 2b: count (% in fragrance oil) | | | | | |
| total others: count (% in fragrance oil) | | | | 4 (25.40%) | 4 (11.94%) |

TABLE 10

| Material | Group | Resilient/ Active | Estimated Threshold | Mix E | Mix F |
|---|---|---|---|---|---|
| Florosa | 2a | | 0.000 12% | 0.00012% | 0.00012% |
| Calone 1951 | 1c | | 0.000 48% | 0.00047% | 0.00048% |
| Petitgrain | | | 0.001 06% | 0.00107% | 0.00106% |
| Pepper Oil Black | 1a | □ | 0.000 82% | 0.00086% | 0.00081% |
| Dihydro Eugenol | 1a | □ | 0.000 96% | 0.00096% | 0.00095% |
| Allyl Hexanoate | 1a | □ | 0.002 35% | 0.00235% | 0.00240% |
| Labienoxime | 1a | □ | 0.000 25% | 0.00025% | 0.00025% |
| Phenyl Ethyl Alcohol | 1b | | 0.002 22% | | 0.00221% |
| Geraniol | 1b | | 0.000 51% | | 0.00051% |
| total 1a: count (% in fragrance oil) | | | | 4 (72.60%) | 4 (50.20%) |
| total 1b: count (% in fragrance oil) | | | | | 2 (30.91%) |
| total 1c: count (% in fragrance oil) | | | | 1 (7.78%) | 1 (5.41%) |
| total 2a: count (% in fragrance oil) | | | | 1 (2.05%) | 1 (1.40%) |
| total 2b: count (% in fragrance oil) | | | | | |
| total others: count (% in fragrance oil) | | | | 1 (17.57%) | 1 (12.08%) |

TABLE 11

| Material | Group | Resilient/ Active | Estimated Threshold | Mix G | Mix H | Mix I |
|---|---|---|---|---|---|---|
| Mandarin Aldehyde | | | 0.011 72% | 0.11696% | | |
| Methyl Benzoate | 1a | □ | 0.006 07% | | 0.06071% | 0.06055% |
| Tetrahydro Linalol | 1b | | 0.000 20% | 0.00200% | 0.00201% | 0.00202% |
| Iso Butyl Quinoline | | | 0.000 65% | 0.00662% | | |
| Anisic Aldehyde | 1a | □ | 0.000 10% | | 0.00096% | 0.00097% |
| Ambrox DL | | | 0.001 56% | 0.01557% | 0.01559% | 0.01561% |
| Cosmone | 1a | □ | 0.000 75% | 0.00767% | | |

TABLE 11-continued

| Material | Group | Resilient/ Active | Estimated Threshold | Mix G | Mix H | Mix I |
|---|---|---|---|---|---|---|
| Habanolide | 1a | ☐ | 0.004 07% | | 0.04067% | 0.04114% |
| Phenyl Acetic Acid | | | 0.005 43% | 0.05419% | 0.05424% | 0.05424% |
| Decalactone Gamma | | | 0.000 36% | 0.00361% | 0.00365% | 0.00359% |
| 9-Decen-1-ol | 1b | | 0.004 32% | 0.04321% | | |
| Labienoxime | 1a | ☐ | 0.000 25% | | 0.00247% | 0.00247% |
| Tetrahydro Geraniol | 1b | | 0.010 87% | | | 0.10849% |
| Citronellol | 1b | | 0.003 07% | | | 0.03070% |
| total 1a: count (% in fragrance oil) | | | | 1 (3.07%) | 3 (58.13%) | 3 (32.88%) |
| total 1b: count (% in fragrance oil) | | | | 1 (18.10%) | 0 (1.12%) | 2 (44.16%) |
| total 1c: count (% in fragrance oil) | | | | | | |
| total 2a: count (% in fragrance oil) | | | | | | |
| total 2b: count (% in fragrance oil) | | | | | | |
| total others: count (% in fragrance oil) | | | | 3 (78.83%) | 3 (40.75%) | 3 (22.97%) |

TABLE 12

| Material | Group | Resilient/ Active | Estimated Threshold | Mix J | Mix K | Mix L |
|---|---|---|---|---|---|---|
| Benzaldehyde | | ☐ | 0.000 64% | 0.00064% | | |
| Methyl Benzoate | 1a | ☐ | 0.006 07% | | 0.00607% | 0.00607% |
| Tetrahydro Linalol | 1b | ☐ | 0.000 20% | 0.00020% | 0.00020% | 0.00020% |
| Silvial | 1a | ☐ | 0.003 59% | 0.00359% | 0.00359% | 0.00359% |
| PTBCHA | | ☐ | 0.003 03% | 0.00303% | | |
| Pepper Oil Black | 1a | ☐ | 0.000 82% | | 0.00082% | 0.00082% |
| Ionone Beta | | ☐ | 0.000 90% | 0.00090% | | |
| Habanolide | 1a | ☐ | 0.004 07% | | 0.00407% | 0.00407% |
| Aurantiol | | ☐ | 0.000 09% | 0.00009% | 0.00009% | 0.00009% |
| Allyl Hexanoate | 1a | ☐ | 0.002 35% | 0.00235% | 0.00235% | 0.00235% |
| Citronellyl Acetate | | ☐ | 0.002 89% | 0.00289% | | |
| Tetrahydro Geraniol | 1b | ☐ | 0.010 87% | | 0.01087% | 0.01087% |
| Phenyl Ethyl Alcohol | 1b | ☐ | 0.002 22% | | | 0.00222% |
| Citronellol | 1b | ☐ | 0.003 07% | | | 0.00307% |
| total 1a: count (% in fragrance oil) | | ☐ | | 1 (43.39%) | 3 (60.22%) | 3 (50.67%) |
| total 1b: count (% in fragrance oil) | | ☐ | | 0 (1.47%) | 1 (39.45%) | 3 (49.05%) |
| total 1c: count (% in fragrance oil) | | ☐ | | | | |
| total 2a: count (% in fragrance oil) | | ☐ | | | | |
| total 2b: count (% in fragrance oil) | | ☐ | | | | |
| total others: count (% in fragrance oil) | | ☐ | | 4 (55.14%) | 1 (0.33%) | 1 (0.28%) |

TABLE 13

| Material | Group | Resilient/ Active | Estimated Threshold | Mix M | Mix N | Mix O |
|---|---|---|---|---|---|---|
| Florosa | 2a | ☐ | 0.000 12% | 0.00012% | | |
| Citral Dimethyl Acetal | 1a | ☐ | 0.030 75% | | 0.03055% | 0.03054% |
| Calone 1951 | 1c | ☐ | 0.000 48% | 0.00048% | 0.00048% | 0.00048% |
| Iso Bornyl Acetate | 1c | ☐ | 0.005 50% | 0.00552% | | |
| Cineole | 1a | ☐ | 0.000 02% | | 0.00002% | 0.00002% |
| Ambermax | 1c | ☐ | 0.000 26% | 0.00026% | 0.00026% | 0.00026% |
| Coumarin | 1c | ☐ | 0.000 39% | 0.00039% | 0.00039% | 0.00039% |
| Nutmeg Oil | | ☐ | 0.001 58% | 0.00160% | 0.00158% | 0.00159% |
| Allyl Cyclohexyl Propionate | 2a | ☐ | 0.008 68% | 0.00870% | | |
| Damascone Delta | 1a | ☐ | 0.000 25% | | 0.00025% | 0.00025% |
| Mefrosol | 1b | ☐ | 0.005 13% | 0.00512% | | |

TABLE 13-continued

| Material | Group | Resilient/ Active | Estimated Threshold | Mix M | Mix N | Mix O |
|---|---|---|---|---|---|---|
| Hexyl Cinnamic Aldehyde | 1a | ☐ | 0.016 50% | | 0.01637% | 0.01643% |
| Citronellol | 1b | ☐ | 0.003 07% | | | 0.00306% |
| Terpineol Alpha | 1a&1b | ☐ | 0.020 51% | | | 0.02050% |
| total 1a: count (% in fragrance oil) | | ☐ | | | 3 (0.00%) | 3 (78.21%) |
| total 1b: count (% in fragrance oil) | | ☐ | | 1 (23.08%) | | 1 (8.34%) |
| total 1c: count (% in fragrance oil) | | ☐ | | 2 (29.96%) | 2 (2.26%) | 2 (1.52%) |
| total 2a: count (% in fragrance oil) | | ☐ | | 1 (39.76%) | | |
| total 2b: count (% in fragrance oil) | | ☐ | | | | |
| total others: count (% in fragrance oil) | | ☐ | | 1 (7.20%) | 1 (97.74%) | 2 (11.93%) |

Perfumes created according to the present invention displayed higher odor intensities, and in some aspects significantly higher odor intensities, than comparative perfumes using the test method described above. For demonstration purposes, care was taken that the perfumes did not contain materials whose main odor character was shared with other materials in the perfume. This effectively minimised (or excluded) additive effects caused by two similar odors at or around threshold exciting the same receptors and thus resulting in an above-threshold activity level at that receptor. Thus the perfumes of the invention are shown to have a higher intensity, which arises from a synergistic interplay between the ingredients. It has been traditionally understood that such phenomena are rare. The present invention allows for the formulation of perfumes with internal synergy in a reliable, repeatable fashion. The present invention provides a method for formulating such perfumes, and further, the perfumes themselves cover a wide odor range and offer benefits. Perfume is often one of the more expensive components of consumer products, so any such broadly-applicable increase in intensity is valuable to the formulator.

While the invention has been described above with reference to specific embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims.

We claim:

1. A method of preparing a perfume composition, comprising the steps of:

a. determining a threshold level of at least one member selected from the group (1A) consisting of acetyl cedrene, Camphor powder synthetic, Cedarwood oil, cineole, cinnamic aldehyde, cistus labdanum, citral dimethyl acetal, (5E)-3-methylcyclotetradec-5-en-1-one, 2,4-dimethyl-3-cyclohexene-1-carbaldehyde, beta damascone, delta damascone, 3-methyl-5-(2,2,3-trimethylcyclopent-3-enyl)-pent-4-en-2-ol, ethyl vanillin, eugenol, 1-(5,5-dimethylcyclohexenyl)pent-4-enone, gamma undecalactone, heliotropin, hexyl cinnamic aldehyde, 2,3,8,8-tetramethyl-1,2,3,4,5,6,7,8-octahydro-2-napthalenyl methyl ketone, alpha iso methyl ionone, (4-(1-methylethyl)cyclohexylmethanol), methyl chavicol, methyl cinnamate, methyl ethyl 2 butyrate, hexadecanolide and cyclopentadecanone, (3-(4-isobutylphenyl)-2-methylpropional), alpha terpineol, allyl hexanoate, 2,4,4,7-tetramethyl-6,8-nonadiene-3-one oxime, anisic aldehyde, Black Pepper Oil, sandalwood, (12E)-oxacyclohexadec-12-en-2-one, dihydroeugenol, 2,6-dimethylhept-5-enal, undeca-1,3-dien-5-yne, methyl benzoate, Raspberry ketone, and mixtures thereof;

b. combining at least four members selected from groups (1A) and (1B), including said at least one member from group (1A) having the determined threshold level in an amount equal to or less than said threshold level, and at least one member selected from the group (1B) consisting of alkyl alcohols, phenyl alkylalcohols, terpene hydrocarbons and mixtures thereof, wherein said at least one member selected from the group the (1B) is present in an amount of from about 10% to about 50% by weight of the perfume composition;

wherein said perfume composition is free of any member selected from the group (2A) consisting of allyl cyclohexyl propionate, Bangalol, Bourgeonal, Cassis bases, ethyl methyl phenyl glycidate, ethylene brassylate, Florosa, Herboxane, cis 3 hexenyl methyl carbonate, Jasmatone, lemon, 2-methyl-3(para-t-butylphenyl) propionaldehyde, methyl anthranilate, Methyl Laitone, phenyl ethyl phenylacetate, Rose oxide, Styrallyl acetate, 6-acetyl-1-isopropyl-2,3,3,5-tetramethylindane, Ultravanil, Ylang oil and mixtures thereof.

2. The method of claim 1, wherein said step of combining comprises adding said at least one member having the determined threshold level in an amount less than said threshold level.

3. The method of claim 1, further comprising the step of adding said perfume composition to a consumer product.

4. The method of claim 1, wherein said step of combining comprises combining up to three members of the group (1C) consisting of aldehyde C12, anethole, amber, iso bornyl acetate, 7-methyl-3,4-dihydro-2H-1,5-benzodioxepin-3-one, coumarin, cuminic aldehyde, Ginger oil, Oakmoss synthetic, Patchouli oil, 4-methyl-3-decen-5-ol, Vetiver oil; and mixtures thereof.

5. The method of claim 1, wherein said step of combining comprises combining a member selected from the group (2A) consisting of allyl cyclohexyl propionate, 2-ethyl-4-(2,2,3-trimethylcyclopent-3-enyl)but-2-enol, 3-(4-tertbutylphenyl)-propanal, Cassis bases, ethyl methyl phenyl glycidate, ethylene brassylate, 2-isobutyl-4-methyltetrahydropyran-4-ol, 2-butyl-4,4,6-trimethyl-1,3-dioxane, cis 3 hexenyl methyl carbonate, 2-hexylcyclopentanone, 3,7-dimethylnona-2(3),6-dienenitrile, 2-methyl-3(para-t-butylphenyl)propionaldehyde, methyl anthranilate, 8-methyl-1-oxaspiro(4,5)decan-2-one, phenyl ethyl phenylacetate, Rose oxide, Styrallyl acetate, 6-acetyl-1-isopropyl-2,3,3,5-tetramethylindane, 2-ethoxy-4-methoxyphenol, Ylang oil and mixtures thereof, wherein the total amount of the 2A members is present in an amount up to about 0.6% by weight of the composition.

* * * * *